US006029287A

United States Patent [19]

Ge et al.

[11] Patent Number: 6,029,287

[45] Date of Patent: Feb. 29, 2000

[54] POWER FLUSH TANK WITH VOLUME REDUCTION TUBE

[75] Inventors: Ming Ge, Farmington Hills; Erik J. Oberg, Ypsilanti, both of Mich.; Danny G. Orlowski, Jr., Holland, Ohio

[73] Assignee: Sloan Valve Company, Franklin Park, Ill.

[21] Appl. No.: 09/149,845

[22] Filed: Sep. 8, 1998

[51] Int. Cl.[7] ..... E03D 3/10

[52] U.S. Cl. ..... 4/354; 4/334; 4/415

[58] Field of Search ..... 4/354, 334, 353, 4/363, 378, 415, 361, 362, 359

[56] References Cited

U.S. PATENT DOCUMENTS 3,732,577 5/1973 Moon ..... 4/18
3,879,765 4/1975 Moon ..... 4/1
4,233,698 11/1980 Martin ..... 4/354

*Primary Examiner*—Henry J. Recla
*Assistant Examiner*—Huyen Le
*Attorney, Agent, or Firm*—Dorn, McEachran, Jambor & Keating

[57] ABSTRACT

A pressure flushing system for use within a toilet tank includes a pressure tank which has a predetermined volume. There is a water outlet for the tank, a water inlet for the tank, and an air inlet for the tank. The air inlet is associated with the water inlet whereby water flowing into the tank draws air into the tank. A portion of the tank is thus occupied by water and a portion is occupied by air, with the air applying pressure to the water. There is a valve within the tank which controls the flow of water from the tank through the outlet. The volume of water within the tank which may flow through the outlet at any one operation of the valve is limited by a dam which is located within the tank and surrounds the outlet.

1 Claim, 1 Drawing Sheet

POWER FLUSH TANK WITH VOLUME REDUCTION TUBE

THE FIELD OF THE INVENTION

This invention relates to pressure flush tanks and power flush systems of the type disclosed in U.S. Pat. No. 4,233,698 owned by the assignee of the present application, Sloan Valve Company of Franklin Park, Ill. Power flushing systems are advantageous, particularly in this era of mandated lower flow volumes for flushing toilets, in that a measured amount of water is discharged into the toilet bowl from the pressure tank at a pressure greater than that provided by a gravity flow system. Pressure flush tanks for such systems must withstand internal pressures from 20 to 35 psi and must be of a size to fit within the boundaries of the tank of a conventional gravity flow toilet. Thus, the pressure tank is limited as to its size, but also must be able to withstand a predetermined internal pressure. Such tanks that have heretofore been placed on the market had an internal volume of approximately two gallons, a portion of this volume being filled by air and a much larger portion by water. With the new mandated water volumes for flushing toilets, it became necessary to either decrease the size of the pressure tank, to reduce the amount of water that would be discharged during a flushing operation, or to use the existing tank and provide a means for limiting the volume of water that would be discharged at a single flush. The present invention is directed to the latter.

SUMMARY OF THE INVENTION

The present invention relates to pressure flushing systems and in particular to such a system which includes means for limiting the volume of water flow at each flushing operation.

Another purpose of the invention is a pressure flush tank which includes a dam located about the tank outlet for limiting the volume of water which can be discharged in a flushing operation.

Another purpose of the invention is to provide a pressure tank for a pressure flushing system in which the tank provides the optimum relationship between air volume and water volume to provide a predetermined flow volume at each flushing operation.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
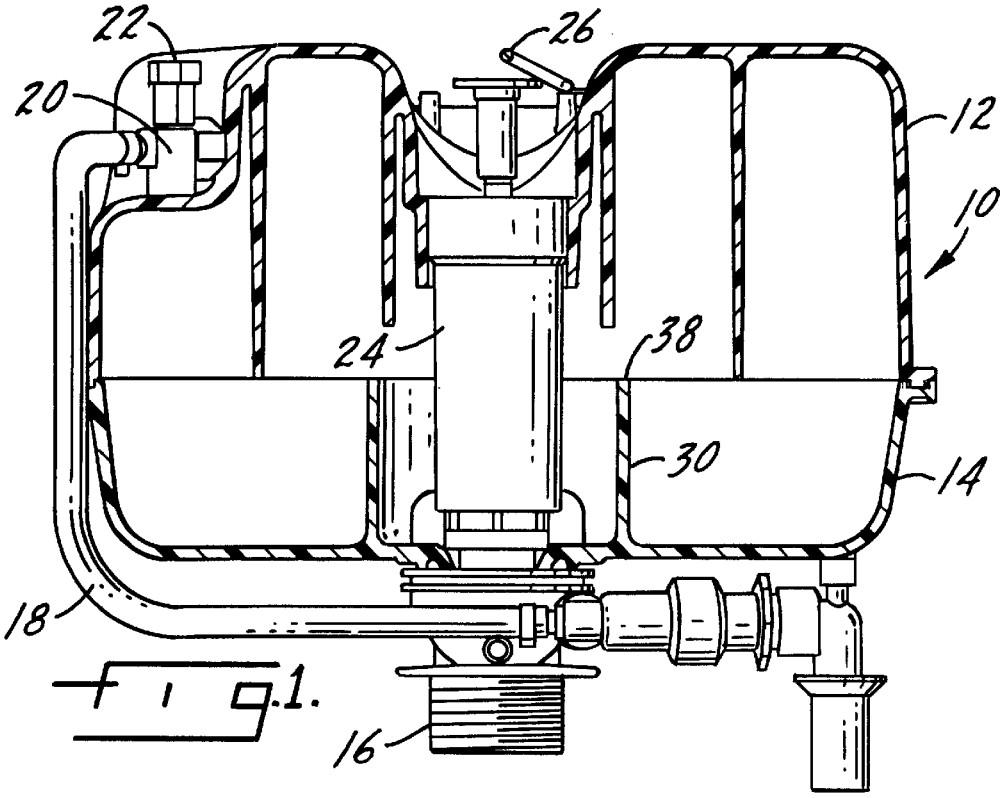
FIG. 1 illustrates a pressure flushing system, with the tank shown in part section.
Figure 2:
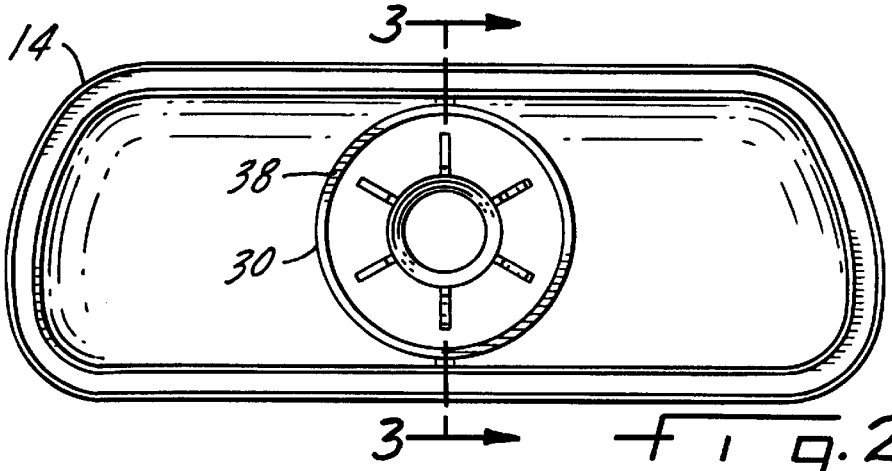
FIG. 2 is a top view of the bottom section of the pressure flush tank.

Pressure flushing systems are designed to provide a more powerful flow of water than a gravity toilet, but yet operate on existing water line pressure. Such toilets utilize a pressure tank which is fed by water at line pressure, with the water drawing air into the tank, with an end result that the water within the tank is pressurized at line pressure to provide a pressure assist when the toilet is flushed. The tank in such a pressure system must be built to fit within the confines of the tank of a typical gravity toilet, but yet withstand pressures up to 35 psi. Normal line pressures in most areas in which gravity type toilets are used may vary from 20 psi to 80 psi. However, the pressure tank has a regulator which limits the internal pressure of the tank to 35 psi. Thus, the pressure tank typically will have water at a pressure of between 20 and 35 psi ready for use as a flushing medium.

Many government regulations now mandate that the amount of water used for a single flush cannot exceed 4 liters or approximately 1.05 gals. The volume in most existing pressure flush tanks is 1.94 gals. It has been determined that the most efficient tank volume to provide adequate air pressure and a 4 liter water flush is 1.25 gals. Thus, a pressure tank having a total volume of 1.25 gals can provide a water volume per flush of 1.05 gals and have adequate volume for air which will provide a pressure of between 25 to 35 psi. The present invention is specifically designed to utilize the 1.94 pressure tank volume and limit the amount of water which can be discharged at a single flush to 1.05 gals. The effect of the volume limiting device of the present invention is therefore to provide a tank which has the desired efficiency of a 1.25 gal total tank volume, but yet do so with a tank which has a total capacity of 1.94 gals.

The present invention is specifically directed to an improvement on the pressure flush tank shown in U.S. Pat. No. 4,233,698, which is herein incorporated by reference.

In FIG. 1, a pressure flush tank is indicated generally at 10 and has a top section 12 and a lower or bottom section 14, both of which may be made of a suitable plastic. There is an outlet 16 which conventionally will be connected to the inlet of a toilet, for example as shown in FIG. 1 of the '698 patent. The tank 10 will be positioned within the tank of a typical gravity flow toilet and the outlet 16 will feed into the bowl of the toilet.

The water supply for the tank 10 is provided by a conduit 18 which may carry water at typical residential line pressure which may vary from 20 to 80 psi. The conduit 18 connects to a combined air and water inducer 20 which will feed water into the tank 10 and at the same time through a venturi effect, as shown in the '698 patent, draw air in through an inlet 22. Thus, both air and water will be provided to the tank 10 with the end result that the tank will fill up to a predetermined volume of water, with the remaining space being filled by air which will be at water line pressure, assuming line pressure is 35 psi or below. If water line pressure is above 35 psi, a regulator will limit air pressure to 35 psi.

A flush valve is indicated generally at 24. This valve may be operated by a lever 26, connected to or operable by the toilet lever, to discharge water from within the tank 10 through the outlet 16 to the toilet tank. The manner in which the flush valve 24 operates may be as shown in the '698 patent. What is important is that there be a tank which will be filled with water up to a certain level and pressurized by air at essentially line pressure and then the ability to discharge water under that pressure into the toilet tank.

Figure 3:
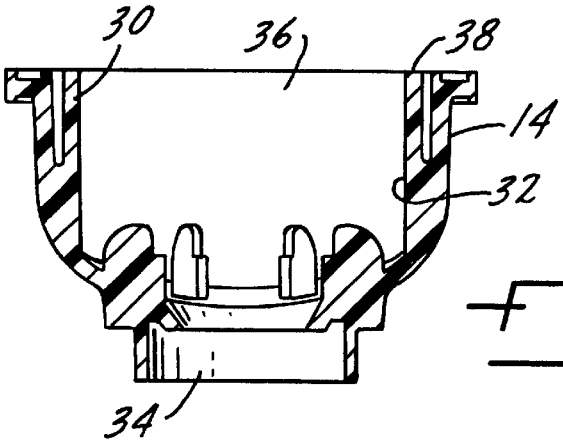
FIG. 3 is a section along plane 3—3 of FIG. 2.

The valve assembly 24, which discharges water through the outlet 16, is surrounded by a dam 30, the effect of which is to limit the access of the water within the tank 10 to the area directly beneath the valve and above the outlet 16. FIG. 3 illustrates the details of the outlet and it includes a sleeve 32 having a bottom opening 34, with the top of the sleeve being open as at 36 to the area outside of valve assembly 24 and inside of dam 30.

As indicated above, the effect of dam 30 is to prevent any water within the tank which is at or below the top 38 of the dam from flowing out through the outlet 16 when the flush valve is operated. Only water above the top 38 of the dam may flow into the area around the flush valve 24 and thus out through the outlet 16.

Using the example described above, the total volume of tank 10 may be 1.94 gals. In order to provide a 4 liter water discharge or a 1.05 gal water discharge, it is desired to have a total tank volume of 1.25 gals, with the 0.2 gal volume difference being that required for air to create the pressure which forces the water to the outlet when the flush valve is operated. The effect of dam 30 is to limit the useful volume of the tank 10 to 1.25 gals. The tank will still have a total volume of 1.94 gals, but because the dam 30 prevents any water below the top of the dam from being usable in a flushing operation, the effective volume of the tank is 1.25 gals. Thus, the dam 30 provides a means for limiting the volume of water discharged in a single flush to 4 liters and yet provide a tank whose effective volume is the most efficient for providing water, under the required pressure, when the flush valve is operated.

The dam is shown as being circumferentially arranged about the flush valve, but if the flush valve were to be located other than centrally of the tank, the dam may be positioned differently. What is important is that the dam limit the effective volume of the tank so that only a predetermined amount of water within the tank can flow through the outlet when the flush valve is operated.

Whereas the preferred form of the invention has been shown and described herein, it should be realized that there may be many modifications, substitutions and alterations thereto.

The embodiments of the invention in which an exclusive property or privilege is claimed are defined as follows:

1. A pressure flushing system for use within a toilet tank including a pressure tank having a predetermined volume, a water outlet at the bottom of said tank, a water inlet for said tank, an air inlet for said tank associated with said water inlet whereby water flowing through said water inlet into said tank draws air into said tank, such that said tank, prior to discharge, has a portion thereof occupied by water and a portion occupied by air, the air applying a pressure to the water which is no greater than water inlet pressure, valve means within said tank controlling the flow of water from said tank, through said outlet, to a toilet bowl, and means for limiting the water within said tank which flows through said outlet to a toilet tank upon operation of said valve means to an amount less than the volume of water within said tank prior to operation of said valve means, said limiting means including a dam molded as one-piece structure with said tank bottom, extending about said tank outlet, and restricting the amount of water which can flow to said outlet to that volume which is located above and within the dam.

* * * * *